US007404219B2

(12) United States Patent
Berkey

(10) Patent No.: US 7,404,219 B2
(45) Date of Patent: Jul. 29, 2008

(54) PORTABLE INFANT BED WITH SIDE WALL VENTILATION

(75) Inventor: Cindy Berkey, Honey Brook, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 11/760,044

(22) Filed: Jun. 8, 2007

(65) Prior Publication Data

US 2007/0289060 A1 Dec. 20, 2007

Related U.S. Application Data

(60) Continuation-in-part of application No. 11/362,264, filed on Feb. 24, 2006, now abandoned, which is a division of application No. 10/808,597, filed on Mar. 25, 2004, now Pat. No. 7,003,821, which is a continuation-in-part of application No. 29/185,439, filed on Jun. 30, 2003, now Pat. No. Des. 500,213.

(51) Int. Cl.
*A47D 7/00* (2006.01)
*A47D 13/06* (2006.01)
*A47C 21/04* (2006.01)

(52) U.S. Cl. ..... 5/98.1; 5/99.1; 5/93.1; 5/655

(58) Field of Classification Search ..... 5/98.1, 5/99.1, 93.1, 655
See application file for complete search history.

(56) References Cited

U.S. PATENT DOCUMENTS 2,253,024 A * 8/1941 Farrand ..... 5/98.1
2,287,907 A 6/1942 Schettler, Jr.
2,464,866 A * 3/1949 Holtz ..... 5/98.1
2,486,054 A * 10/1949 Morse ..... 5/99.1
2,586,247 A * 2/1952 Mover ..... 5/97
2,587,255 A * 2/1952 Vogel et al. ..... 5/98.3
2,691,177 A * 10/1954 Leonard ..... 5/98.3
2,784,420 A * 3/1957 Moltane ..... 5/98.1
2,908,021 A * 10/1959 Fulton ..... 5/99.1
2,922,169 A * 1/1960 Werner ..... 5/98.1
2,992,441 A * 7/1961 Landry ..... 5/99.1
RE25,195 E * 7/1962 Hamilton ..... 5/98.1
3,063,065 A * 11/1962 Shaw ..... 5/99.1
3,064,277 A * 11/1962 Gill ..... 5/98.1
3,095,583 A * 7/1963 Golub et al. ..... 5/99.1
3,165,760 A * 1/1965 Abajian ..... 5/97
3,183,528 A * 5/1965 Jacobs et al. ..... 5/99.1
3,206,772 A * 9/1965 Sarasin ..... 5/99.1
3,206,773 A * 9/1965 Sarasin ..... 5/99.1
3,233,254 A * 2/1966 Golub et al. ..... 5/99.1
3,309,718 A * 3/1967 Sarasin ..... 5/98.1
3,438,069 A 4/1969 Long
3,474,472 A * 10/1969 Hamilton, II ..... 5/98.1

(Continued)

*Primary Examiner*—Robert G Santos
(74) *Attorney, Agent, or Firm*—Lempia Braidwood LLC

(57) ABSTRACT

A portable infant bed has a bottom panel with a perimeter and a top sleeping surface. A side wall is connected to the perimeter of the bottom panel around a periphery of the bed. The bottom panel and side wall are foldable and unfoldable between an in-use configuration with the side wall extending up from the perimeter and surrounding the sleeping surface and a folded configuration with the side wall lying generally parallel with and adjacent the bottom panel. A vent through a portion of the side wall positioned at a level near the sleeping surface, the vent permitting air to pass freely through the side wall.

17 Claims, 14 Drawing Sheets

U.S. PATENT DOCUMENTS 3,789,439 A * 2/1974 Berg et al. ..... 5/99.1
3,894,304 A 7/1975 Burbidge et al.
3,924,280 A * 12/1975 Vaiano ..... 5/98.1
4,044,411 A * 8/1977 Peterson ..... 5/99.1
4,070,716 A * 1/1978 Satt et al. ..... 5/99.1
4,073,017 A * 2/1978 Stevens ..... 5/97
4,186,454 A * 2/1980 Cone ..... 5/99.1
4,202,065 A * 5/1980 Sullivan ..... 5/99.1
4,376,318 A * 3/1983 Cirillo ..... 5/99.1
4,455,697 A * 6/1984 Rovida ..... 5/99.1
4,493,120 A * 1/1985 Watts ..... 5/99.1
4,538,309 A 9/1985 Gunter et al.
4,651,367 A * 3/1987 Osher et al. ..... 5/99.1
4,692,953 A * 9/1987 Fetters ..... 5/99.1
4,739,527 A 4/1988 Kohus et al.
4,750,223 A * 6/1988 D'Arcy et al. ..... 5/99.1
4,811,437 A 3/1989 Dillner et al.
4,819,285 A * 4/1989 Fetters ..... 5/99.1
4,899,496 A * 2/1990 Chew, II ..... 5/98.1
4,921,369 A 5/1990 Chew et al.
4,985,948 A * 1/1991 Mariol ..... 5/99.1
4,999,863 A * 3/1991 Kane ..... 5/98.1
5,163,191 A 11/1992 Chan
D365,957 S 1/1996 Ferrari
5,544,372 A * 8/1996 Garland et al. ..... 5/99.1
5,553,336 A 9/1996 Mariol
5,560,055 A * 10/1996 Ziegler ..... 5/99.1
5,581,827 A * 12/1996 Fong et al. ..... 5/98.1
5,697,111 A 12/1997 Dillner
5,727,265 A * 3/1998 Ziegler et al. ..... 5/99.1
5,752,283 A * 5/1998 Arens ..... 5/99.1
5,778,465 A 7/1998 Myers
5,826,285 A 10/1998 Mariol et al.
5,845,349 A 12/1998 Tharalson et al.
5,862,548 A 1/1999 Gerhart
5,867,850 A 2/1999 Mariol
5,867,851 A 2/1999 Mariol et al.
5,933,885 A 8/1999 Glassford
6,058,528 A 5/2000 Yang
6,131,216 A 10/2000 Pine
6,131,218 A 10/2000 Wang
6,148,456 A * 11/2000 Tharalson et al. ..... 5/99.1
6,170,101 B1 1/2001 McCloud
6,178,573 B1 1/2001 Wagner et al.
6,178,578 B1 1/2001 Soltani et al.
6,182,308 B1 2/2001 Yang
6,192,535 B1 2/2001 Warner
6,250,837 B1 * 6/2001 Mariol et al. ..... 403/102
6,418,575 B1 7/2002 Cheng
6,421,850 B1 * 7/2002 Welsh, Jr. ..... 5/99.1
6,430,762 B1 8/2002 Cheng
6,434,767 B1 8/2002 Welsh, Jr.
6,434,768 B2 * 8/2002 Brown et al. ..... 5/99.1
6,438,772 B1 * 8/2002 Brown et al. ..... 5/99.1
6,510,570 B2 1/2003 Hartenstine et al.
6,578,211 B2 6/2003 Tharalson et al.
6,588,033 B1 7/2003 Welsh et al.
6,704,949 B2 * 3/2004 Waldman et al. ..... 5/93.1
D500,213 S 12/2004 DeHart et al.
6,859,957 B1 3/2005 Chen
6,865,756 B2 3/2005 Clapper et al.
6,907,626 B1 6/2005 Welsh et al.
6,931,677 B2 8/2005 Tharalson et al.
6,934,981 B2 * 8/2005 Waldman et al. ..... 5/95
6,961,968 B2 11/2005 Clapper et al.
7,003,821 B2 * 2/2006 DeHart et al. ..... 5/93.1
7,003,823 B1 * 2/2006 Reed et al. ..... 5/424
2001/0000362 A1 4/2001 Wagner et al.
2002/0092094 A1 * 7/2002 Welsh, Jr. ..... 5/95
2003/0177574 A1 * 9/2003 Waldman ..... 5/93.1
2003/0196263 A1 10/2003 Hardy
2003/0196264 A1 10/2003 Tharalson et al.
2004/0181873 A1 * 9/2004 Waldman et al. ..... 5/95
2004/0237191 A1 12/2004 Clapper et al.
2004/0261174 A1 12/2004 DeHart et al.
2005/0150046 A1 7/2005 Gehr et al.
2005/0166316 A1 8/2005 Gehr et al.
2005/0172400 A1 8/2005 Hardy
2005/0198733 A1 9/2005 Van Huystee
2005/0210580 A1 9/2005 Clapper et al.
2005/0210581 A1 9/2005 Clapper et al.
2006/0207023 A1 9/2006 DeHart et al.
2007/0271697 A1 * 11/2007 Martin ..... 5/93.2
2007/0289060 A1 * 12/2007 Berkey ..... 5/99.1

* cited by examiner

PORTABLE INFANT BED WITH SIDE WALL VENTILATION

This application is a continuation-in-part application claiming priority benefit of U.S. patent application Ser. No. 11/362,264, which was filed on Feb. 24, 2006, and which was entitled "Child Containment Structure with Ventilation Panel." The Ser. No. 11/362,264 application is a divisional application claiming priority benefit of U.S. patent application Ser. No. 10/808,597, filed Mar. 25, 2004, now U.S. Pat. No. 7,003,821, and which is a continuation-in-part of design application Ser. No. 29/185,439, filed Jun. 30, 2003, now U.S. Design Pat. No. D500,213. Each of these related applications is incorporated by reference herein in its entirety.

FIELD OF THE INVENTION

This invention relates to a child containment structure. More specifically, this invention relates to a child containment structure with a ventilation panel to allow passage of air between an interior of the containment structure and an exterior of the containment structure along the child sleeping surface.

BACKGROUND OF THE INVENTION

Child containment structures, such as cribs, bassinets, and playards, provide a safe environment in which a child can rest and/or play. Adequate air circulation along the child sleeping surface is desirable to promote safe and comfortable sleeping. There is a need in the art for an improved child containment structure to promote the passage of air across the child sleeping surface.

SUMMARY OF THE INVENTION

An aspect of the invention relates to a child containment structure that comprises a floor and a sidewall connected to the floor and defining a unitary structure with the floor. The sidewall includes at least one side panel formed at least partially of an air-restricting material and at least one ventilation panel positioned between the floor and the side panel. The ventilation panel has a maximum height smaller than that of the side panel, and the ventilation panel permits air flow between an interior of the containment structure and an exterior of the containment structure along a sleeping surface of the child containment structure.

According to another aspect of the invention, a child containment structure comprises a floor, a sidewall including at least one padded side panel, and at least one ventilation panel positioned between the floor and the side panel to define a unitary structure. The ventilation panel permits air flow between an interior of the containment structure and an exterior of the containment structure along a sleeping surface of the child containment structure.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENT

Reference will now be made in detail to presently preferred embodiments of the invention, examples of which are illustrated in the accompanying drawings. An effort has been made to use the same reference numbers throughout the drawings to refer to the same or like parts.

Child containment structures, such as cribs, bassinets, and playards, provide a safe environment in which a child can rest and/or play. It is important in such child containment structures that adequate air flow be provided across the sleeping surface of the structure. In the past, adequate air flow was achieved by including all-mesh sidewalls in the structure. The child containment structure of the present invention includes a floor, a sidewall, and a ventilation panel as part of the sidewall, strategically located between the side panel of the sidewall and the floor so that adequate air flow occurs between an interior of the containment structure and an exterior of the containment structure along a surface of the floor. The ventilation panel can be dimensioned so that it is substantially level with a child's head when the child is lying down in the child containment structure.

Figure 1:
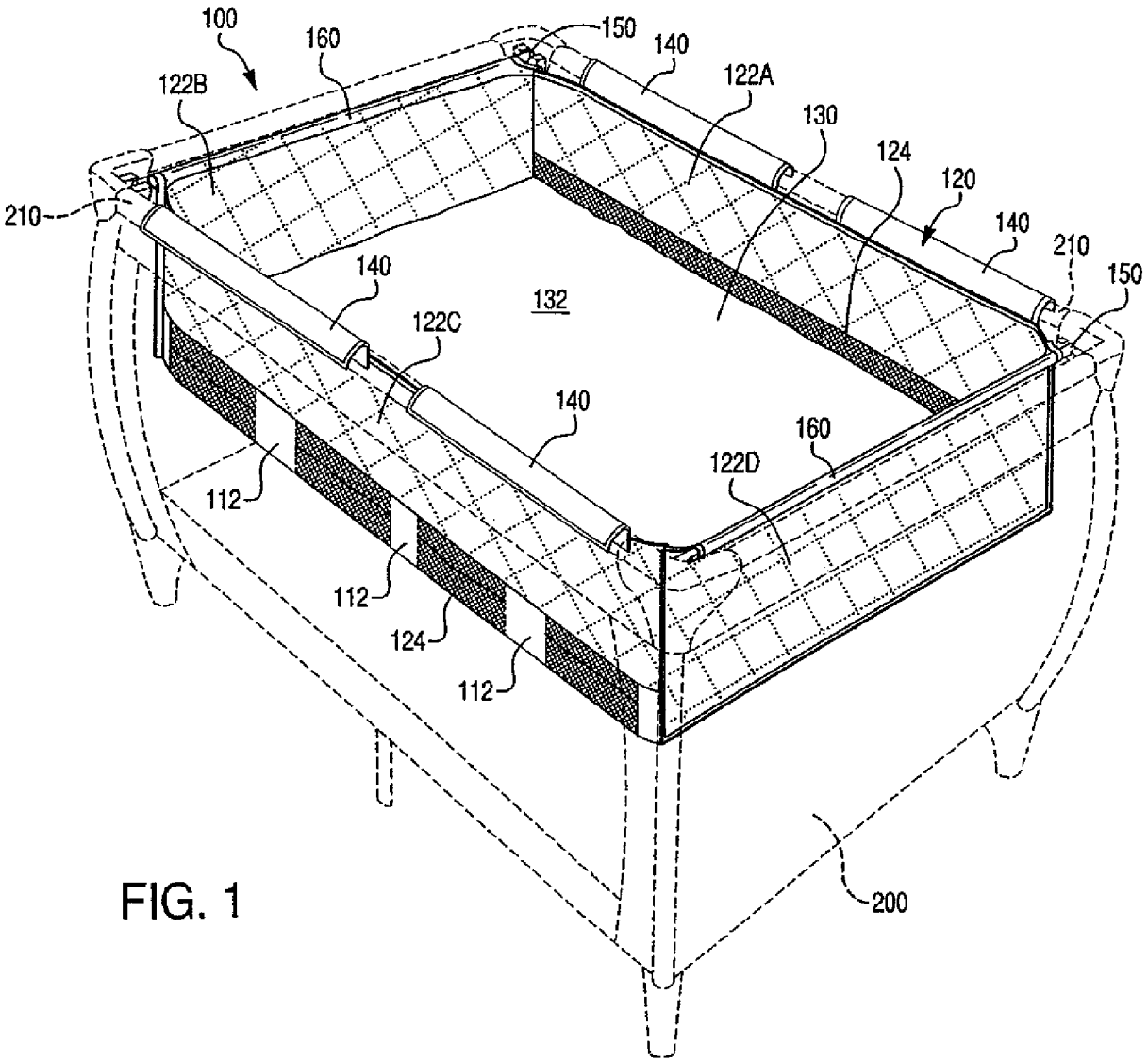
FIG. 1 is a top perspective view of a bassinet that includes a ventilation panel according to an embodiment of the invention mounted to a playard.

Because the child containment structure includes a ventilation panel, the side panel of the sidewall can be made of a more comfortable and more protective fabric material than mesh, even if that material is an air-restricting material. For example, a bassinet designed to be mounted to a playard, as shown in FIG. 1, can include a side panel formed of a quilted material, similar to bumper pad material for a standard crib. As another example, a ventilation panel can be incorporated into the sidewall of a free-standing bassinet, such as that shown in FIGS. 4-5 and that disclosed in U.S. Pat. No. 6,961, 968, filed Mar. 25, 2004 in the name of Joshua E. Clapper et al. and entitled BASSINET AND CHANGING TABLE ASSEMBLY, which is incorporated by reference herein in its entirety. The free-standing bassinet has soft comfortable side panel material. Further, a playard for outdoor use having a water-protective floor can include a ventilation panel at its lower corners, both for ensuring adequate air flow where the side panels meet and for water drainage in the event of inclement weather.

Figure 2:
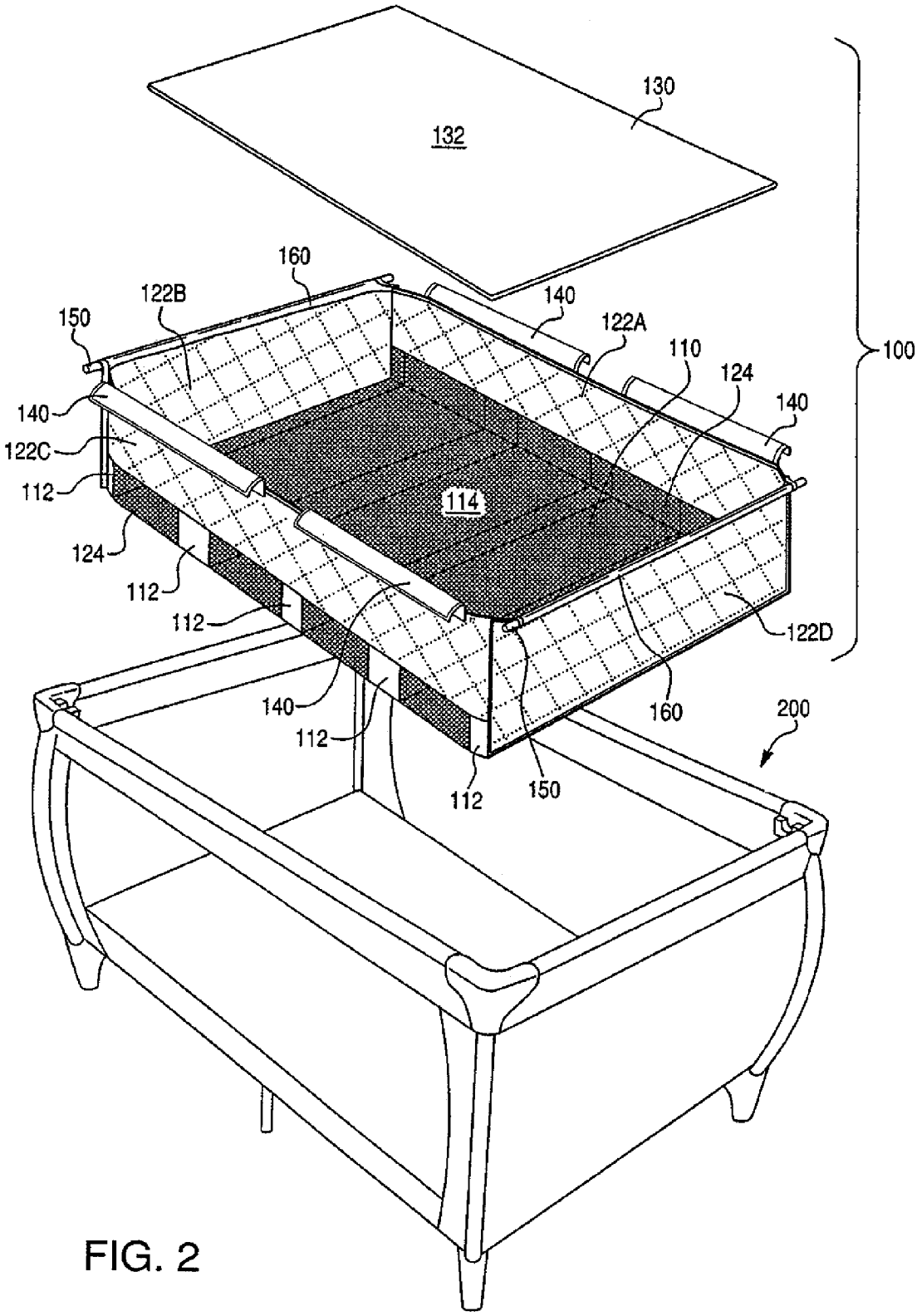
FIG. 2 is an exploded view of the bassinet and playard of FIG. 1.
Figure 3:
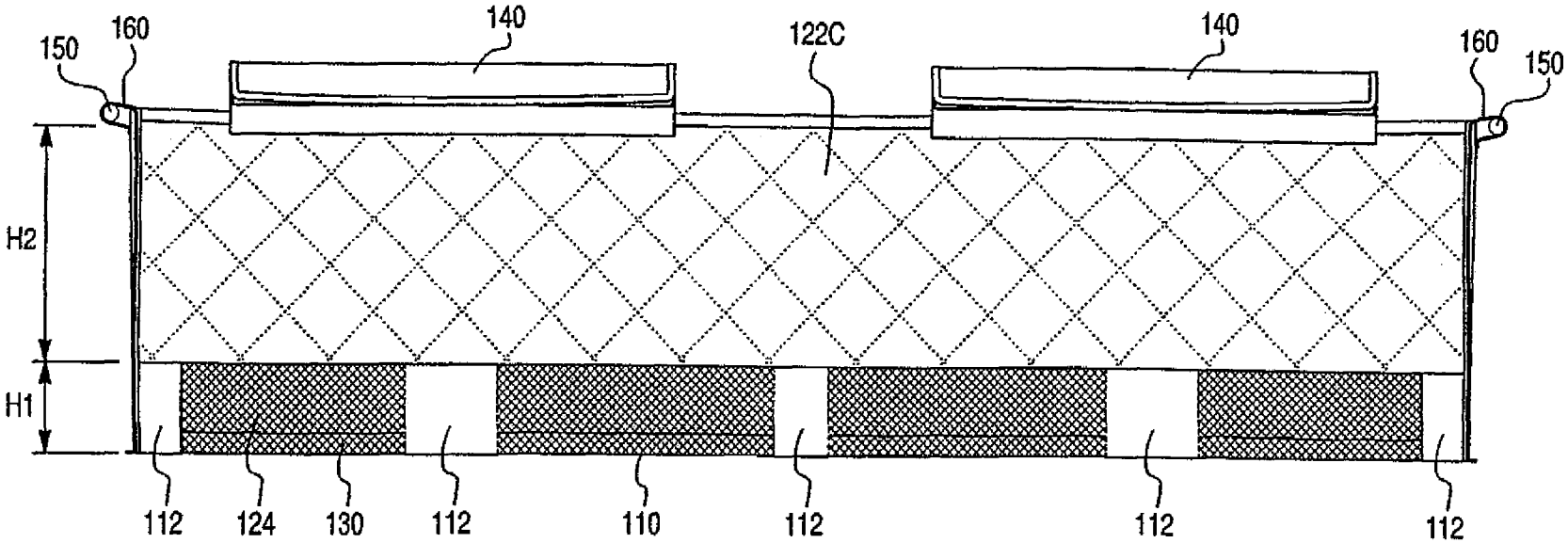
FIG. 3 is a side elevation view of the bassinet of FIG. 1.

FIGS. 1-3 show an embodiment of a child containment structure in accordance with the invention. The child containment structure of this embodiment is a bassinet 100 that is mounted to a playard 200. The playard 200 is shown in dashed line in FIG. 1 for ease of understanding of the bassinet structure. The bassinet 100 includes a floor 110, shown best in FIG. 2, and a sidewall 120 connected to the floor 110 to define a unitary structure with the floor 110. The floor 110 can be planar, or it can curve upward at its edges to join sidewall 120. The floor 110 can be formed of a mesh material, as shown in FIGS. 1-3, or it can be formed of any other suitable material, such as nylon, polyester, a poly nylon blend, and cotton. A mattress pad 130 can be positioned above the floor 110 of the bassinet 100 to provide a comfortable sleeping/playing surface for the child. A fitted sheet can be placed over the mattress pad 130 for additional comfort. Alternatively, the floor 110 itself can include padding to provide a cushioned sleeping/playing surface.

The sidewall 120 of this embodiment includes four side panels 122A, 122B, 122C, 122D arranged in a rectangular shape. The side panels 122A, 122B, 122C, 122D of this embodiment are formed of quilted padding. In other embodiments, the side panels 122A, 122B, 122C, 122D can be formed of nylon, polyester, a poly nylon blend, cotton, Lycra.RTM. or other materials that provide a comfortable, protective environment for the child. Side panels 122A, 122C additionally include a ventilation panel 124 positioned between the floor 110 and the respective side panels 122A, 122C. The ventilation panels 124 each have a maximum height Hi smaller than the maximum height H2 of their respective side panel 122A, 122C, as seen in FIG. 3. In addition, the side panels 122A, 122B, 122C, 122D are formed at least partially of an air-restricting material by comparison to the material of the ventilation panels 124. In this regard, the ventilation panels 124 permit air flow between an interior of the bassinet 100 and an exterior of the bassinet 110 along an upper surface 114 of the floor 110.

The ventilation panels 124 can be made of a mesh material, a breathable fabric with a high air flow rate, a perforated rigid material, or any other material that enables sufficient air flow between the interior and the exterior of the bassinet 100. A child lying close to side panels 122A, 122C of the bassinet 100 will have fresh air circulation through the ventilation panels 124 and, thus, will not re-breathe its own expelled air. The ventilation panels 124 provide a comfortable and safe sleeping environment, while enabling use of more versatile side panel material than mesh, such as warmer, softer, and/or darker, light-blocking materials.

As can be seen in FIG. 3, the ventilation panel 124 extends above the upper surface 132 of the mattress pad 130. The ventilation panel 124 can extend, for example, about 1 inch above the pad's upper surface 132.

Various alternatives to the bassinet embodiment illustrated in FIGS. 1-3 are contemplated. It will be understood that in other embodiments of bassinet 100, the sidewall 120 may have more than four, or fewer than four, side panels. For example, the sidewall 120 may be oval in shape and, hence, have only a single side panel, unbroken by a corner joint. It will also be understood that fewer or more side panels than shown in FIGS. 1-3 can include ventilation panels 124. For example, only one or all of the side panels can include respective ventilation panels 124. Further, although the ventilation panels 124 are shown as single continuous strips extending along the entire length of respective side panels 122A, 122C in the embodiment of FIGS. 1-3, other shapes and configurations of segments 124 are envisioned. For example, the single continuous strip may be divided into adjacent segments of ventilation material by nylon or some other air-restricting material, effectively resulting in more than one ventilation panel positioned between the floor and the respective side panel. In addition, the ventilation panels 124 may have a shape that varies along the length of the side panel; for example, the upper edge of the segment may curve or undulate. In the latter example, the height of the ventilation panel 124 would vary along its length, but the maximum height of the ventilation panel still would be smaller than a minimum height of the side panel.

In addition to the above features, the bassinet 100 can include mounting fixture to mount the bassinet 100 to the playard 200. These mounting fixtures can include curved, plastic brackets 140 that suspend the bassinet 100 from the top rails 210 of the playard. The mounting fixtures also can include rods 150 that extend through sleeves 160 at opposite ends of the bassinet 100. The rods 150 can fit into pockets molded into the playard frame. These mounting fixtures are exemplary only; other suitable mounting fixture may be integrated into the bassinet and/or playard to facilitate mounting the bassinet to the playard.

Further, the bassinet 100 also can include straps 112 of webbing extending across the width of the ventilation panel 124 and the floor 100, on an exterior of the bassinet 100, to lend additional structural stability to the floor 110.

Although the bassinet 100 shown in FIGS. 1-3 extends the entire length of the playard 200, it will be understood that, in other embodiments, the bassinet may be dimensioned to extend less than the entire length of the playard, for example, three quarters the length of the playard.

Figure 4:
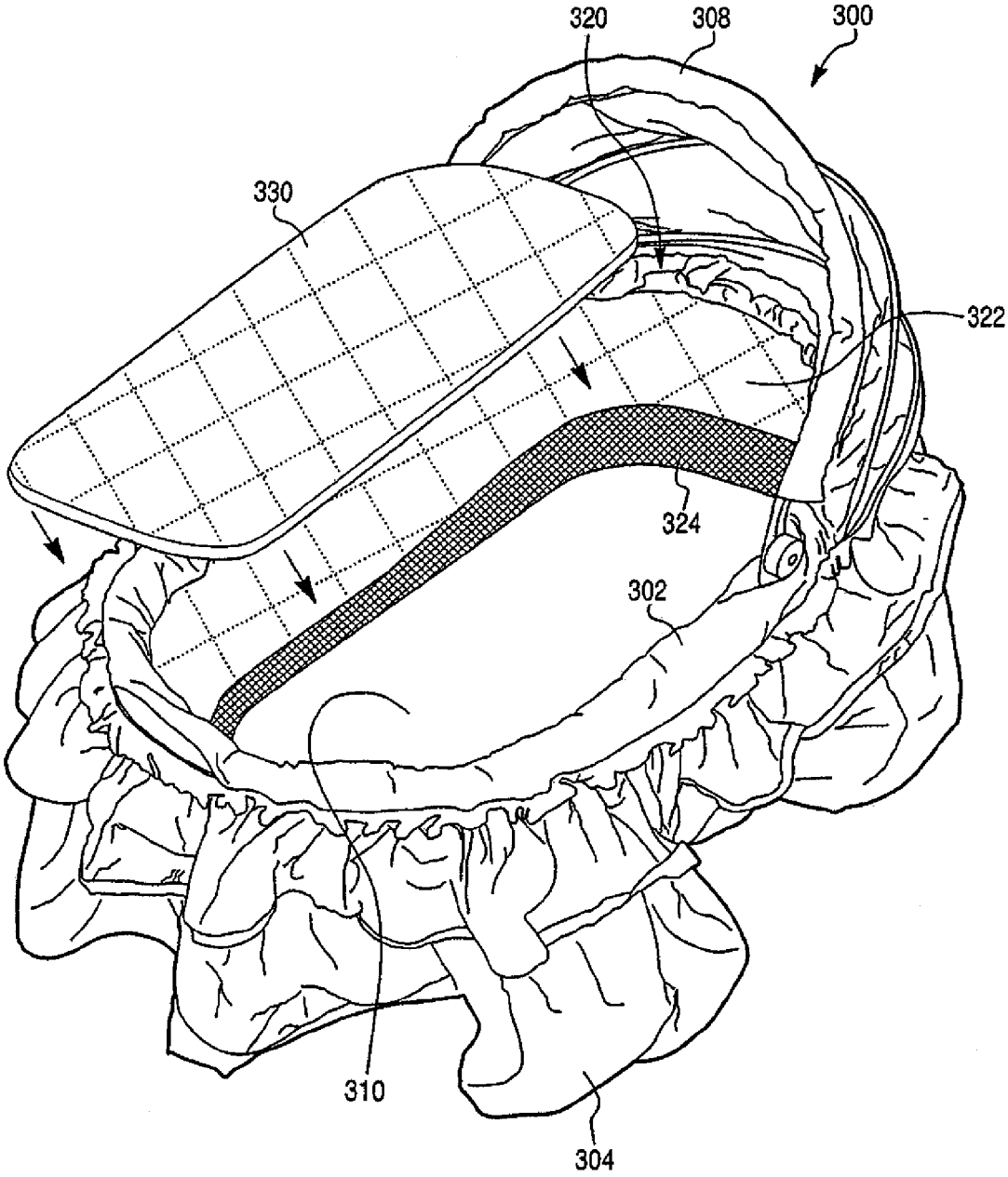
FIG. 4 is a partially exploded, top perspective view of an alternative bassinet that includes a ventilation panel according to an embodiment of the invention.
Figure 5:
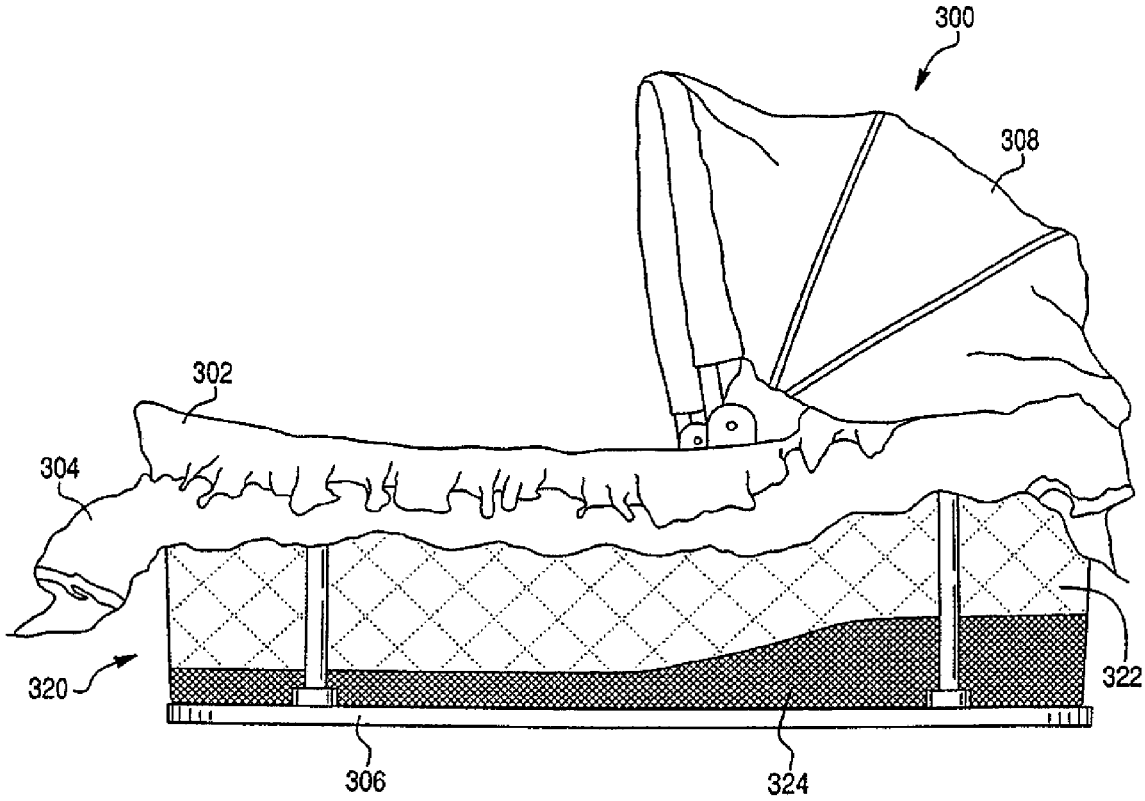
FIG. 5 is a side elevation view of the bassinet of FIG. 4, with a portion of the outer skirt of the bassinet cover cut away to make the ventilation panel visible.

Ventilation panels can be employed in child containment structures other than bassinets for use with playards. FIGS. 4-5 show a free-standing bassinet 300 that includes a fabric bassinet cover 302 and a bassinet frame 304 (obscured in FIG. 4 by the bassinet cover). An example of such a bassinet is disclosed in co-pending application Ser. No. 10/808,593, filed Mar. 25, 2004 in the name of Joshua E. Clapper, published as U.S. Publication No. 2005/0210580, and entitled CHILD SLEEPING ASSEMBLY WITH INCLINABLE SLEEPING SURFACE, which is incorporated by reference herein in its entirety. As described, the bassinet frame includes a base 306 with an inclinable panel (not shown) to allow an end of the bassinet sleeping surface to be elevated. The bassinet cover 302, which is configured to provide a child containment structure when mounted to the frame, has a floor 310 and a sidewall 320 connected to the floor 312 to define a unitary structure with the floor 310. The sidewall 320 includes a single, oval-shaped side panel 322 formed of an air-restricting material. The sidewall 320 also includes a ventilation panel 324 positioned between the floor 310 and the side panel 322. The ventilation panel 324 of this bassinet embodiment is continuous, extending around the entire sidewall 320 of the bassinet 300. The height of the ventilation panel 324 varies along its length. That is, the ventilation panel 324 gradually increases in height as the segment 324 approaches one end of the bassinet 300, shown as the right end in FIG. 5.

The increase in height of the ventilation panel 324 can be advantageous. If a child caregiver wants to raise the bassinet mattress pad 330 to help a child breathe easier, the child caregiver can adjust the pad at the end of the bassinet where the ventilation panel 324 increases in height and still preserve the air flow across the upper surface of the mattress pad 330. In the raised condition, the upper surface of the mattress pad 330 can remain below the upper edge of the ventilation panel 324 so that air can pass freely between the interior and the exterior of the bassinet along the upper surface of the mattress pad 330.

The alternatives discussed above in connection with the structure of the bassinet of FIGS. 1-3, such as the number of side panels and the segmenting of the ventilation panel, apply to the bassinet of FIGS. 4-5 as well.

In addition to the above-described structural features of the bassinet 300, the bassinet cover 302 can include an outer skirt 304 (partially cut-away in FIG. 5). The outer skirt 302 can extend down from an upper edge of the bassinet 300 to the ventilation panel 324, and even beyond the ventilation panel 324; however, the outer skirt 304 is designed to remain spaced from the ventilation panel 324 so that air flow between the interior and the exterior of the bassinet 300 through the ventilation panel 324 is not restricted. The bassinet 300 also can include a collapsible canopy 308.

Figure 6:
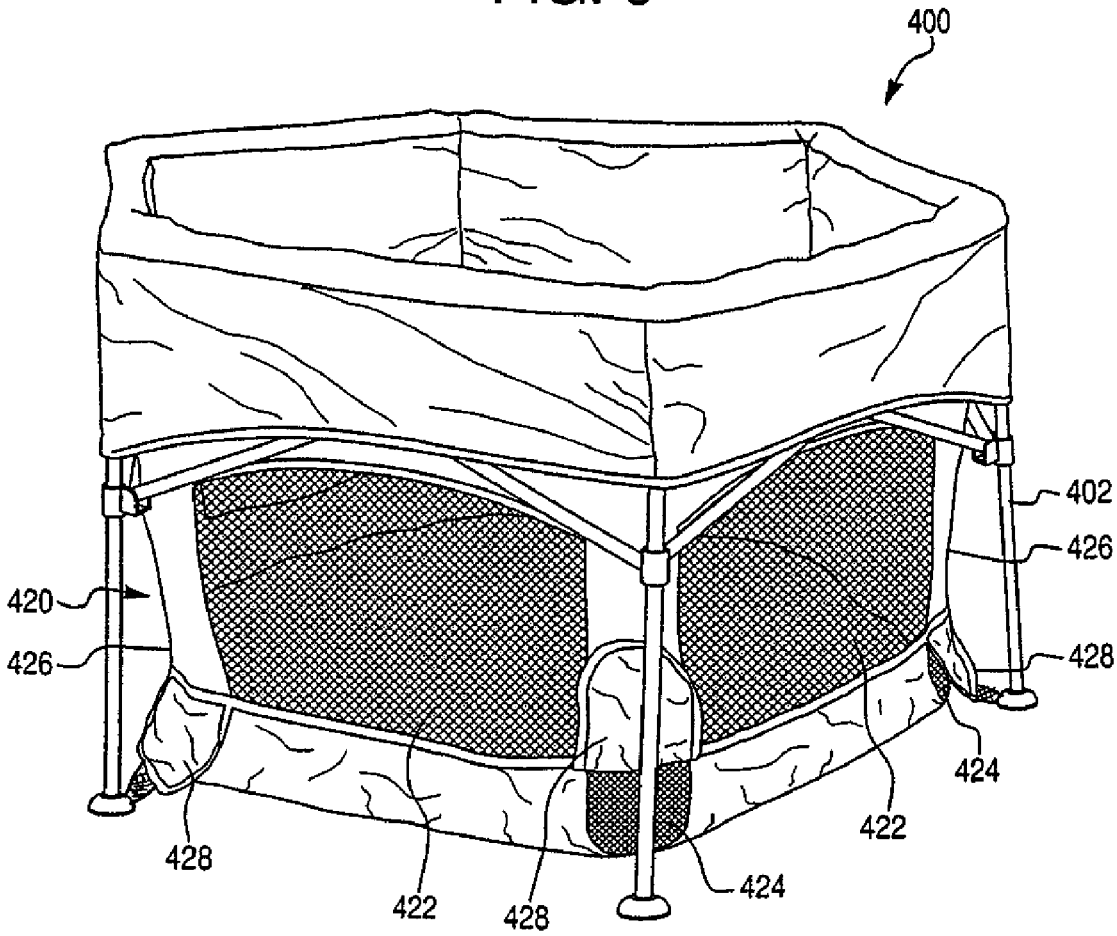
FIG. 6 is a side perspective view of an alternative playard that includes a ventilation panel according to an embodiment of the invention.
Figure 7:
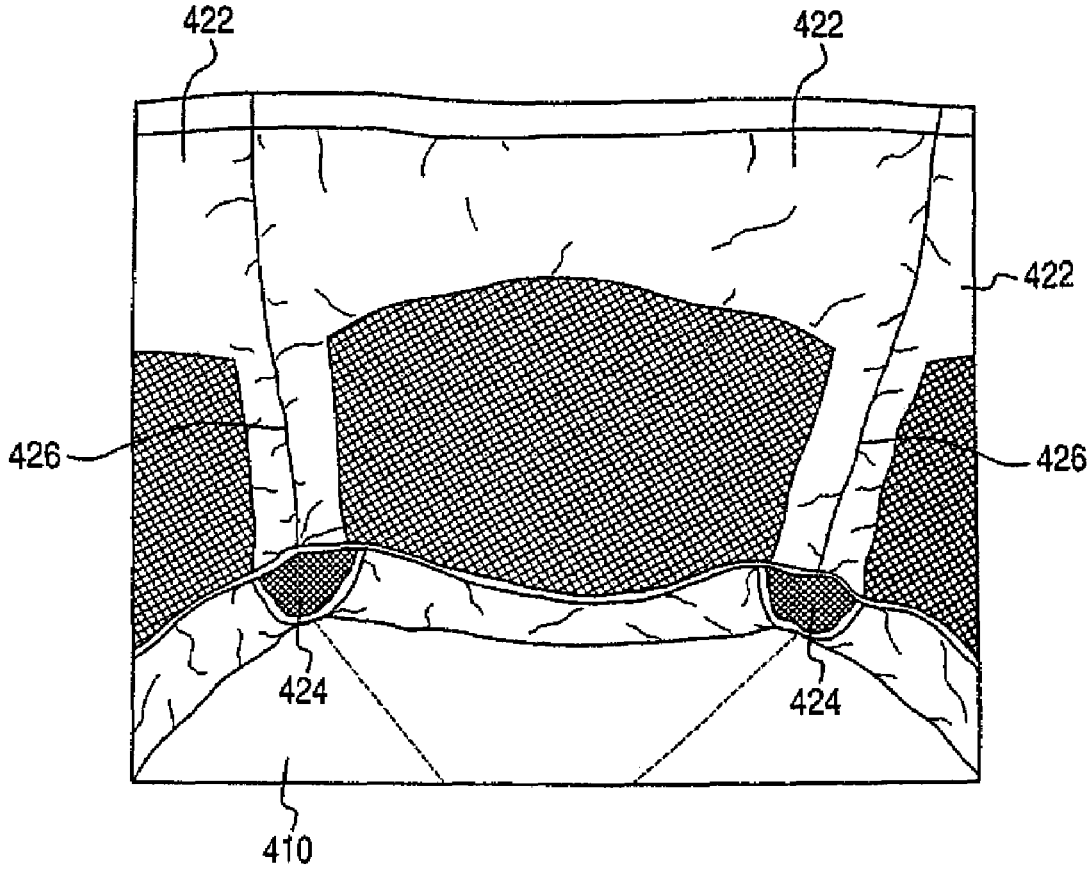
FIG. 7 is an enlarged view of a portion of the playard of FIG. 6, taken from inside of the playard.

FIGS. 6-7 show a playard 400 that includes a frame 402 (a representative frame leg is labeled in FIG. 6), a floor 410, and a sidewall 420 having side panels 422 and ventilation panels 424. An exemplary frame 402 for playard 400 is described in co-pending application Ser. No. 10/446,132, filed May 28, 2003, which is incorporated by reference herein in its entirety. The sidewall 420 is connected to the floor 410 and defines a unitary structure with the floor 410. Adjacent side panels 422 form corners 426, and ventilation panels 424 are located at each corner 426 between the adjacent side panels 422 and the floor 410. The ventilation panels 424 permit air flow between an interior of the playard 400 and an exterior of the playard along the sleeping (or playing) surface of the playard 400. The sleeping surface can be provided by an upper surface of a mattress pad (not shown) placed on the floor 410 or by the floor 410 itself. If the playard 400 is used outdoors, the ventilation panels 424 also serve as a drainage site for any water that enters an interior of the playard 400. In this regard, the floor 410 can be formed of a water-resistant material, and it can be slightly raised at its center so that any water captured in the interior of the playard 400 flows toward the corner ventilation panels 424.

The side panels 422 themselves can be formed of mesh, nylon, a combination of mesh and nylon, as seen in FIGS. 5-6, or any other suitable material. The presence of the ventilation panels 424 enables use of more versatile materials for the side panels 422. For example, the side panels 422 can be formed of a heavier, sturdier, and/or air-restricting material to guard against rough surfaces, wind, water, and sun.

The playard 400 also can include flaps 428 positioned on the exterior of the sidewall 420 to cover each corner ventilation panel 424. These flaps 428 can serve to keep sand or small debris from blowing into the interior of the playard 400 through the corner ventilation panels 424. Although FIG. 6 illustrates one flap 428 rotated up relative to the floor of the playard 400, the flaps 428 extend downward from their connection points to the sidewall 420. In addition, the flaps 428 can be secured to the feet of the respective frame legs by straps, for example, straps of webbing as shown in FIG. 6 (see rightmost and leftmost flaps), to maintain the flaps 428 slightly spaced from the corner ventilation panels 424, thereby promoting air flow through the panels 424.

Figure 8:
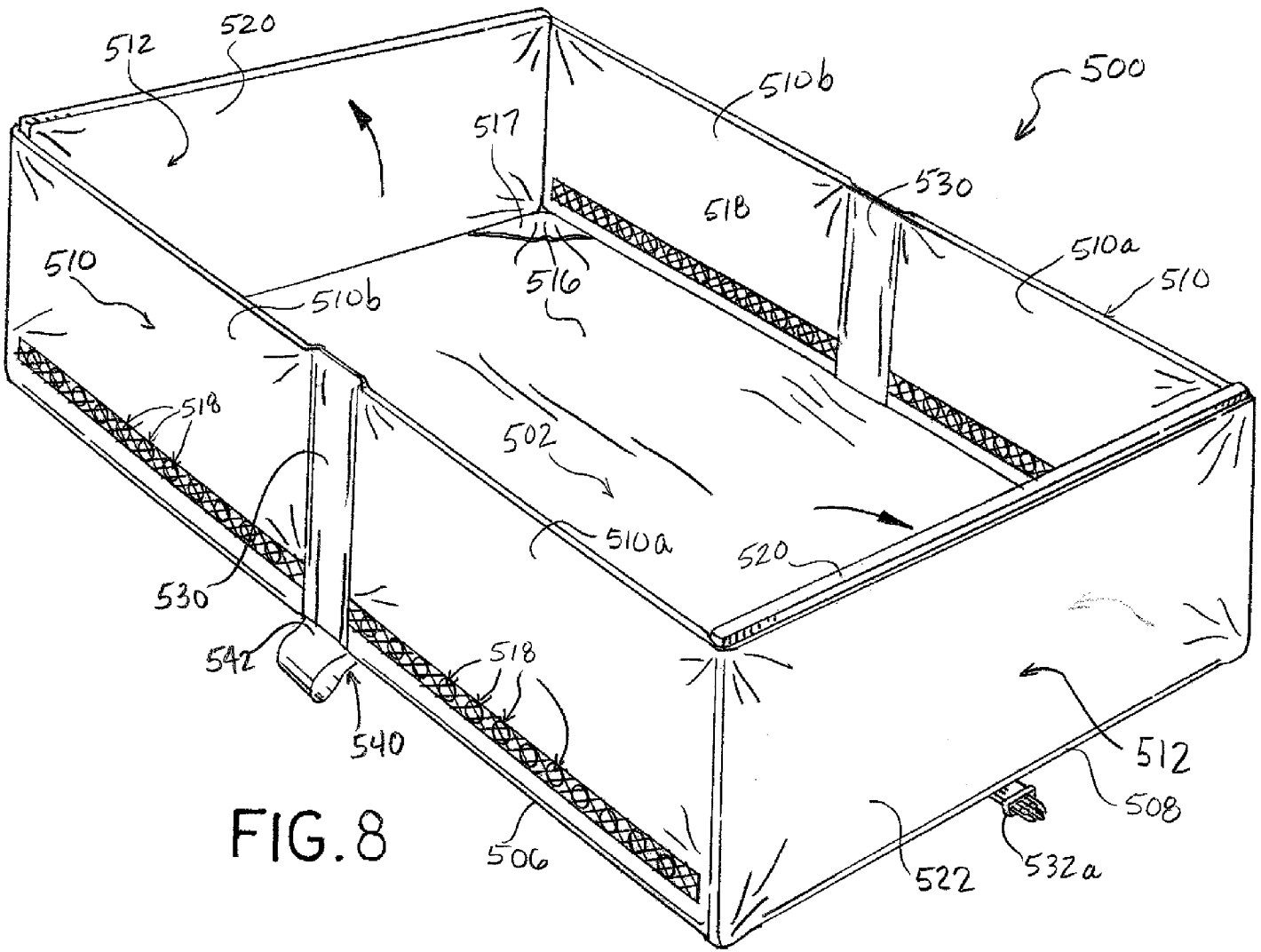
FIG. 8 is a top perspective view of a portable bassinet that includes a ventilation panel according to another embodiment of the invention.

FIGS. 8-14 illustrate another alternative example of a child containment structure with ventilation. In this example, the child containment structure is a foldable and portable bassinet or infant bed 500. As shown in FIG. 8, the portable infant bed 500 generally includes a bottom panel 502 that has a top sleeping surface. A side wall 504 is connected to the perimeter of the bottom panel 502 and can extend upward from the perimeter to surround the sleeping surface. In this example, the bed 500 is rectangular in shape with a pair of elongate side edges 506 at the bottom panel perimeter and a pair of opposed shorter end edges 508 at the bottom panel perimeter. The side wall 504 is created by four interconnected panel segments in this example. The wall panel segments include a pair of opposed side panel segments 510 that are foldably connected to the side edges 506 of the bed 500 and a pair of opposed end panel segments 512 that are foldably connected to the end edges 508 of the bed.

In the disclosed example, the bottom panel 502 has a bottom fabric layer 514 beneath a removable mattress pad 516. The mattress pad 516 rests on the fabric layer 514 and can be secured to the layer 514 and/or the bed 500 in any suitable manner. In one example, a fabric triangle or strip 517 is secured to the bed 500 and extends across each interior corner 515 of the bed. The corners of the mattress pad 516 are secured beneath the strips 517 to hold it in place during use. As in the disclosed example, the mattress pad 516 can be removable for cleaning, replacement and the like, if desired. The mattress pad 516 can alternatively be permanently secured as part of the bed 500, or can be removably secured in place by hook and loop fasteners, snaps, buckles, straps, and/or the like either alone or in combination.

The overall structure of the foldable bassinet 500 in this example is such that the bottom panel and wall panel segments can be folded on top of one another to a relatively flat portable configuration as described below. In the disclosed example, each of the side panel segments 510 includes one or more vents 518 in a lower region of the panel as is also described in greater detail below. The bottom panel 502 has two panel sections 502*a*, 502*b* that are foldable relative to one another so that the bottom panel can be folded in half in this example. To accommodate such folding, the bottom fabric 514 and the mattress pad 516 can be foldable laterally across the middle of the bottom panel. If the mattress pad 516 includes a stiffening panel (not shown) to give some support to the mattress shape, the pad can be provided with two such panels. The two stiffening panels can coincide with the two panel sections 502*a* and 502*b* and lie separate from but coplanar with one another to permit the middle of the bottom panel to fold.

Figure 9:
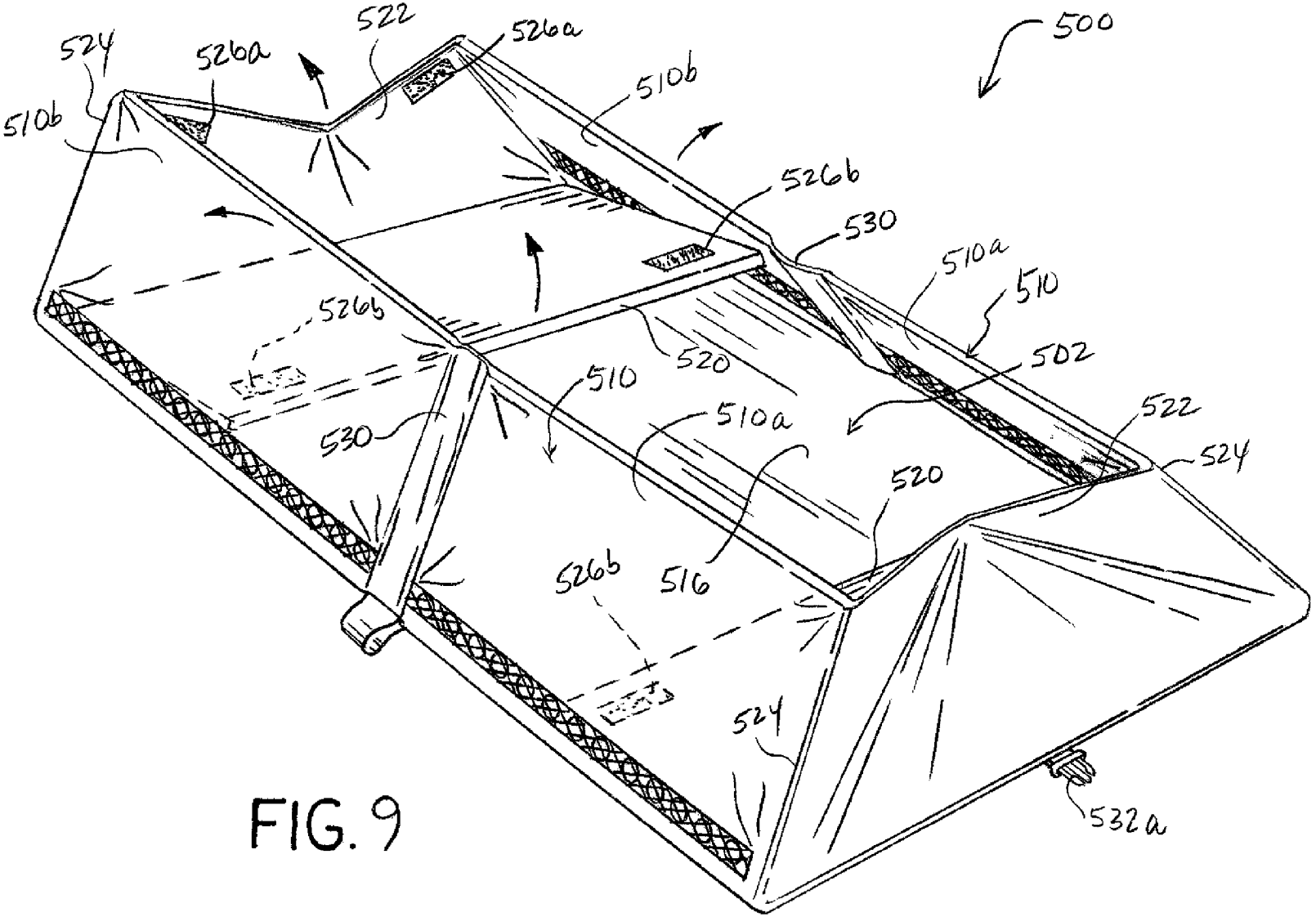
FIG. 9 shows the portable bassinet of FIG. 8 and in a partially collapsed or folded condition.

FIGS. 8-12 show the fold and unfold procedure and the panel arrangement for the portable infant bed 500 disclosed herein. As shown in FIGS. 8 and 9, each disclosed end panel segment 512 is formed of two separable components including an inner support panel 520 and an outer fabric wall 522. The fabric end wall 522 of each end panel 512 is integrally connected with or sewn to adjacent edges of a fabric material 524 at the edges of the side panel segments 512. A bottom edge of the fabric end wall 522 is integrally connected with or sewn to the bottom fabric 514 at each of the end edges 508 of the bottom panel. A bottom edge of each of the inner support panels 520 is sewn to the respective fabric joints at the end edges 508 as well.

As shown in FIG. 9, a plurality of fasteners are employed to detachably connect the inner support panels 520 to the outer fabric end walls 522 in the set up configuration shown in FIG. 8. In the disclosed example, the fasteners are provided in the form of hook and loop fastener devices. One or more hook or loop first parts 526*a* are carried on the interior surface of the outer fabric walls 522 and a corresponding number of loop or hook second parts 526*b* are carried on a back side of the inner support panels 520. The inner support panels 520 can fold along the attached bottom edge from an in-use position shown in FIG. 8 downward toward the bottom panel 502 to a folded position upon release of the fasteners 526*a*, 526*b*. When the inner support panels 520 are folded upward against the fabric end walls 522, the inner support panels are held in place by the fasteners 526*a*, 526*b*. The support panels 520 provide sturdiness and structure to the otherwise limp fabric walls 522 in the disclosed example and create a flat, semi-rigid, resilient panel segment 512 structure. The support panels 520 also assist in retaining the ends of the side panel segments 510 spaced apart across the bed in the upright orientation during use.

The fabric walls 522 can be flimsy and formed of a highly flexible fabric material. As in the prior examples, the material can be an air flow restricting, durable materials such as nylon or the like. Air flow restricting means that air is inhibited from passing through the fabric by the nature of the fabric weave, texture, density, thickness, and/or the like. However, most such fabric materials are not completely air impermeable. The inner support panels 520 can be formed having a more substantial structure, such as including an inner semi-rigid panel section (not shown) that is sturdy and resilient and that can inhibit bending or collapsing of the structure. Thus, when the inner support panels 520 are folded upward and secured by the fasteners to the outer fabric walls 522, the support panels create study end panel segments 512 and keep the side panel segments 510 from collapsing inward toward one another.

As shown in FIG. 9, the fasteners 526*a*, 526*b* can be released to separate the inner support panels 520 from the fabric end walls 522. The inner support panels 520 can be folded downward into contact with the bottom panel 502 and can lie generally parallel with and against the bottom panel. In this configuration, the fabric end walls 522 of the end wall segments 512 are loose and flimsy and can collapse and fold inward toward the bottom panel 502.

Figure 10:
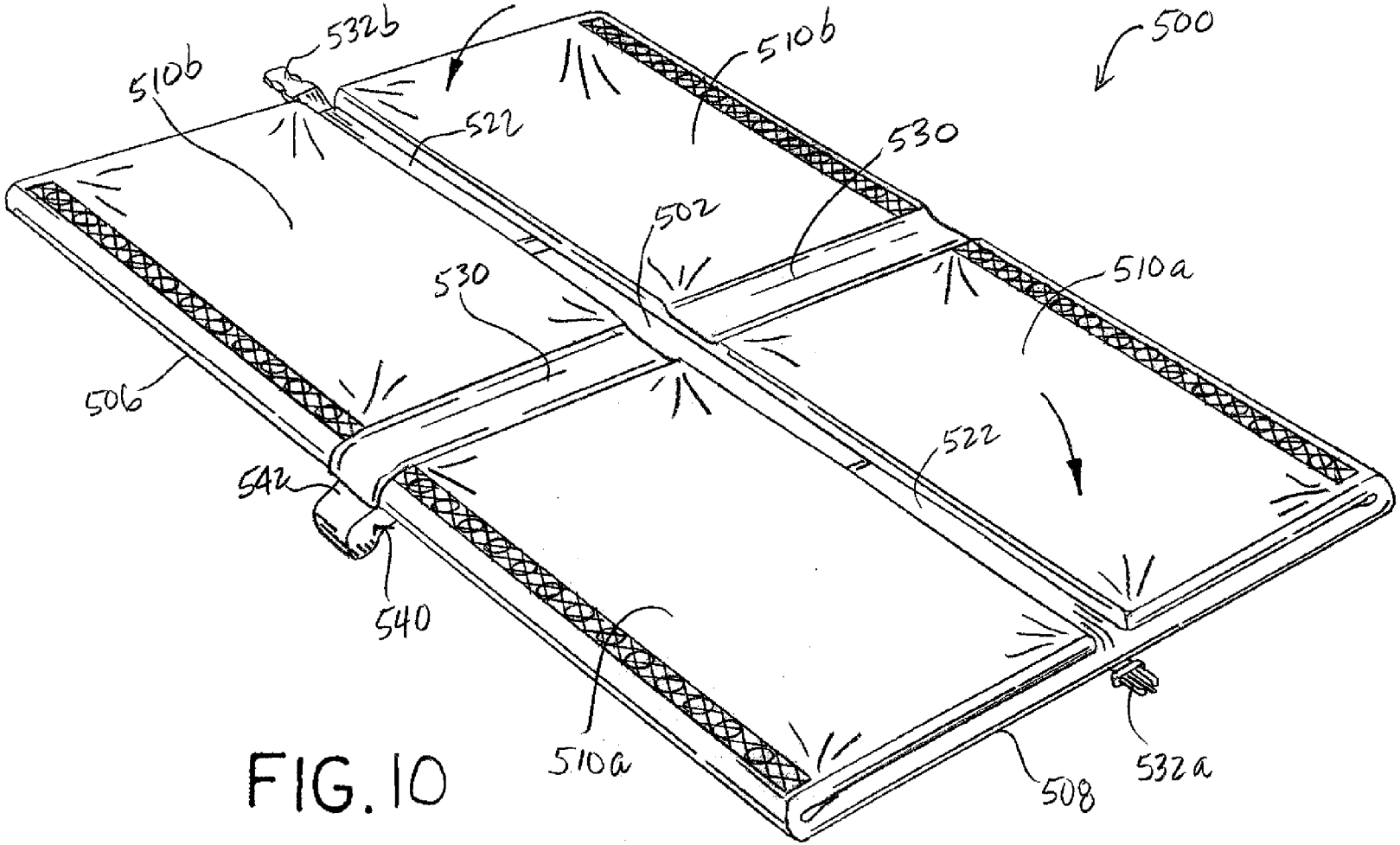
FIG. 10 shows the portable bassinet of FIG. 9 in a further collapsed or folded condition.
Figure 11:
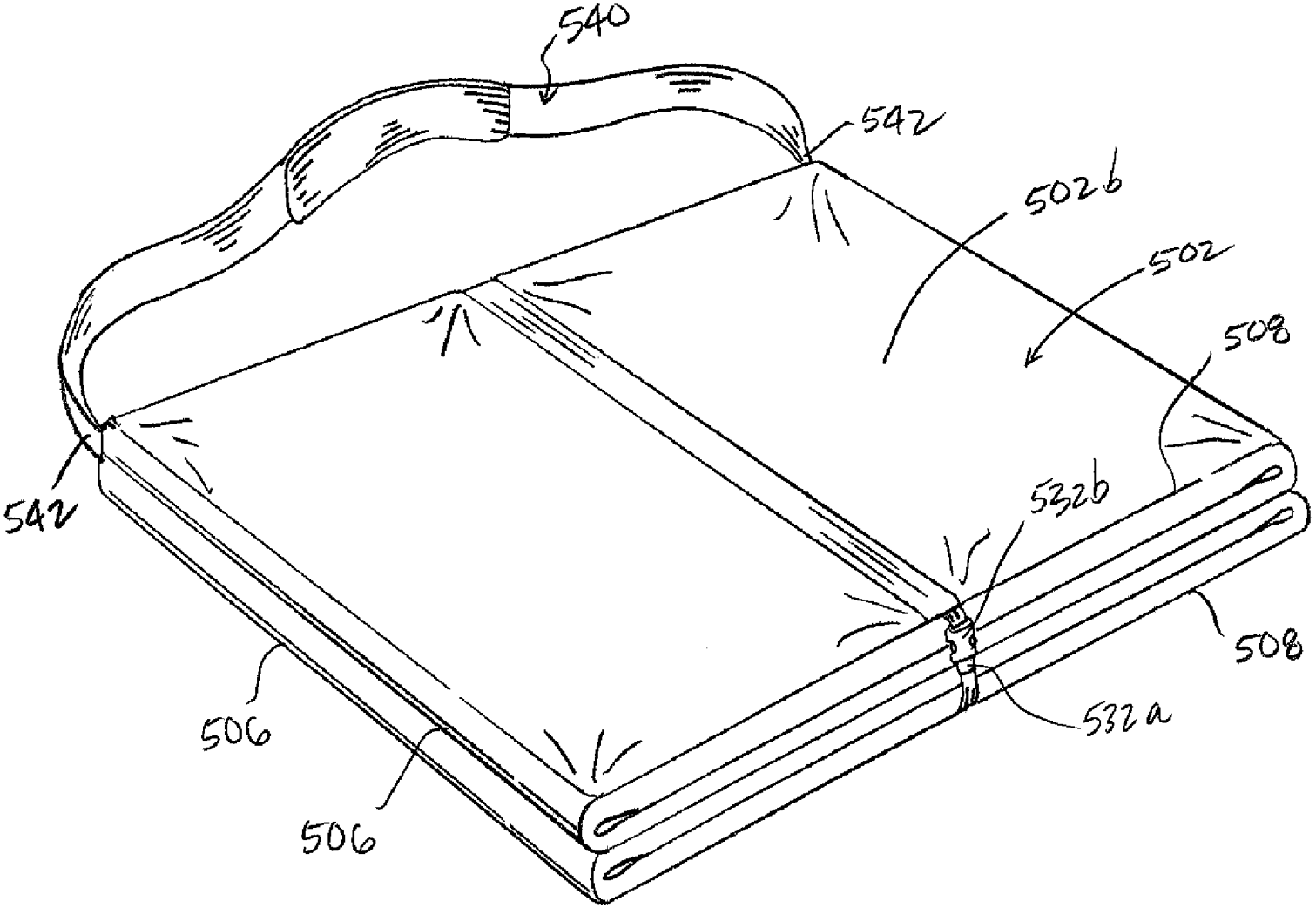
FIG. 11 shows the portable bassinet of FIG. 10 in a fully folded or collapsed condition.

As shown in FIGS. 9 and 10, the side panel segments 510 are each generally divided into two sections 510*a* and 510*b*. A fold region 530 separates the side panel sections 510*a* and 510*b* on each of the side wall segments 510. Each fold region 530 is flexible, is centrally located between the two sections 510*a* and 510*b* on each side panel segment 510, and is of sufficient width to permit folding of the bed 500 as shown in FIGS. 10 and 11. A bottom edge of each of the side panel segments 510 is integral with or sewn to the bottom fabric 514 at the side edges 506 of the bed 500 in this example. The side panel segments 510 can thus fold downward and inward toward the bottom panel similar to the inner support panels 520 of the end wall segments 512.

Once the inner support panels 520 are folded downward onto the bottom panel, the side panel segments 510 are also free to fold downward to a position lying against and generally parallel to the bottom panel 502 as shown in FIG. 10. Upon folding the side panel segments 510 and end panel segments 512 down onto the bottom panel 502, the bed 500 can be folded in half laterally across the middle of the product. As noted above, the bottom fabric 514, the mattress pad 516, and the side panel fold regions 530 permit folding of the bed 500. In the disclosed example, the fold regions 530 are positioned on opposite sides of the bed and coincident with the central portion of the bottom panel 502. As shown in FIG. 11, with the side and end panel segments folded down flat, the two end edges 508 of the bed can be folded upward toward one another. In this configuration, both sections 502*a* and 502*b* of the bottom panel 502 and the various side and end panel segments lie parallel with one another in a generally flat folded-in-half configuration. The side and end panel segments 510 and 512 are sandwiched between the two bottom panel sections in the folded configuration of this example.

Once the bed 500 is folded in-half as shown in FIG. 11, the product can be secured in the condition using a buckle assembly or other suitable fastener. In this example, the buckle assembly incorporates a male buckle part 532*a* along one end edge 508 and a female buckle part 532*b* along the opposite end edge 508 of the bed 500. The buckle components can connect to one another to secure and retain the portable infant bed 500 in the folded-in-half configuration. In alternative examples, the securing fastener can include a pair of straps that are equipped with hook and loop fasteners, a strap and snap configuration, a strap and ring hook and loop fastener arrangement, or the like. For example, a portion of a hook and loop fastener can be provided on the underside of the bottom fabric 514 at one end of the bed and a strap with a corresponding hook or loop fastener section can be provided on the bed near the other end. In a further example, a hoop or ring can be carried on one end of the bed and a strap with both hook and loop fastener elements can be carried on the opposite to be threaded through the ring. These single strap arrangements can also be used to secure the bassinet in this folded configuration. Other fastener arrangements are certainly permissible within the spirit and scope of the present invention.

Figure 12:
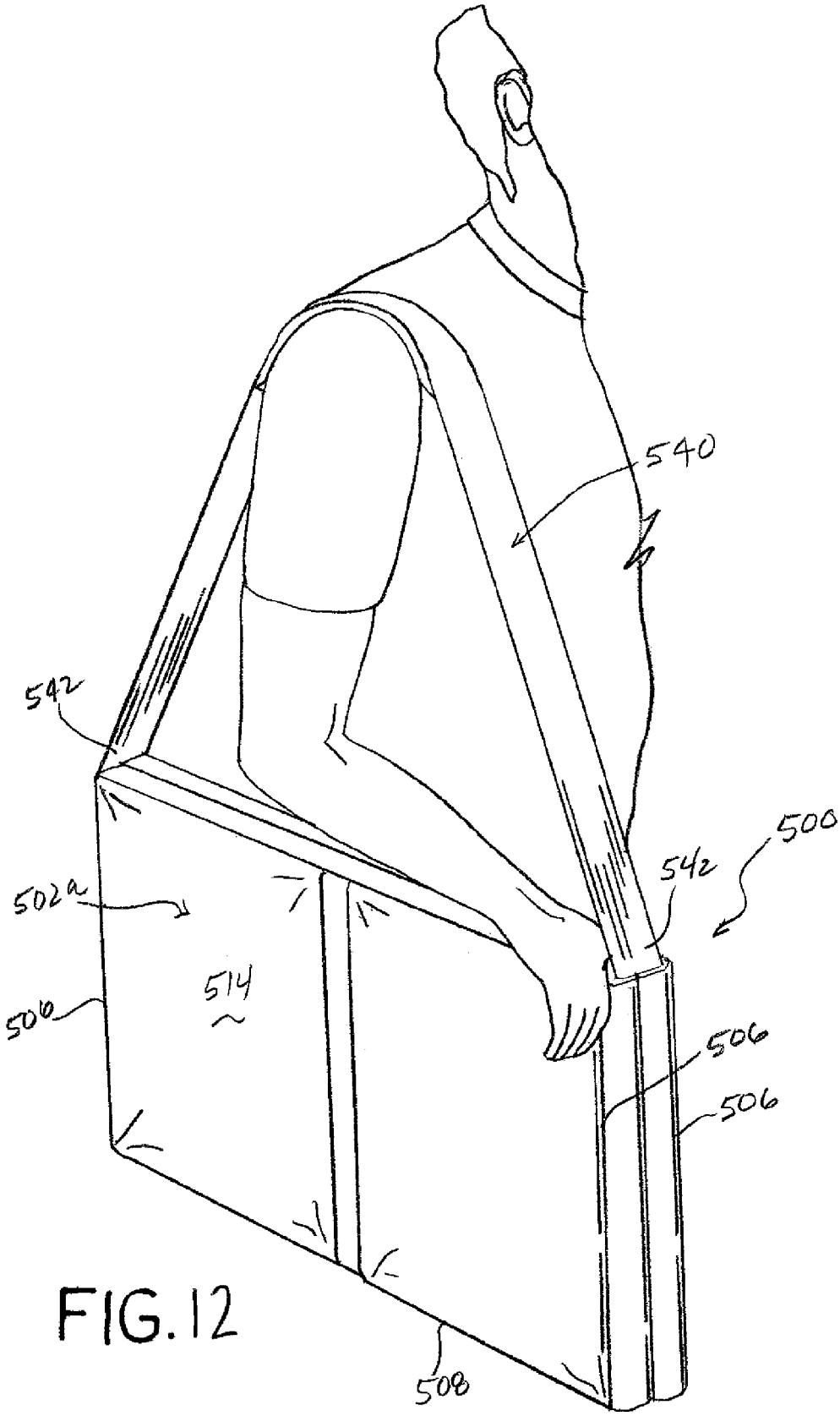
FIG. 12 shows the folded or collapsed portable bassinet of FIG. 11 and being carried by a care giver.

In the disclosed example, the bassinet 500 also is equipped with a carry strap 540. The strap 540 can be used to carry the folded bassinet 500 as depicted in FIG. 12. In this example, the carry strap 540 is arranged to create a shoulder strap and can be a fixed length strap or an adjustable length strap as desired. As shown in FIGS. 8 and 12, ends 542 of the strap 540 can be secured to the opposite side edges 506 of the bed 500 and extend beneath the bed in the in-use configuration. Thus the strap 540 will be exposed when the bassinet is folded in-half as shown in FIG. 11. In another example, a carry handle (not shown) can be provided on the underside of the bottom fabric 514 centrally positioned to coincide with the fold regions 530 in the side walls and the fold region in the mattress pad 516. Alternatively, such a handle can be provided on one of the side edges 506 or end edges 508. Such a carry handle will thus be positioned on one of the exposed edges of the folded-in-half bed of FIG. 11. Other positions, configurations, and arrangements of a carrying device are also certainly permissible within the spirit and scope of the present invention.

Figure 13:
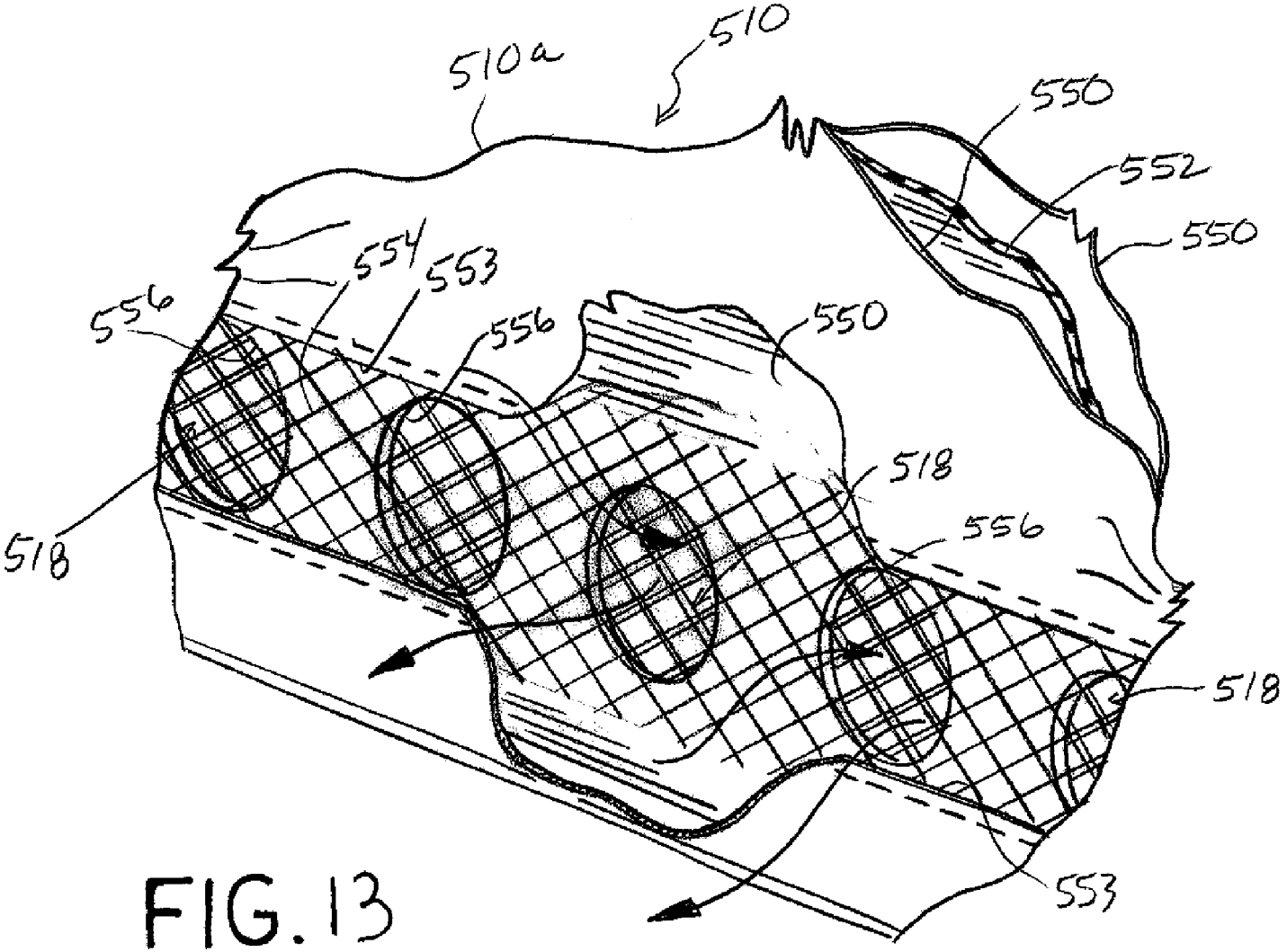
FIG. 13 shows an enlarged partial fragmentary view of a portion of the portable bassinet shown in FIG. 1 and taken from circle XIII-XIII.
Figure 14:
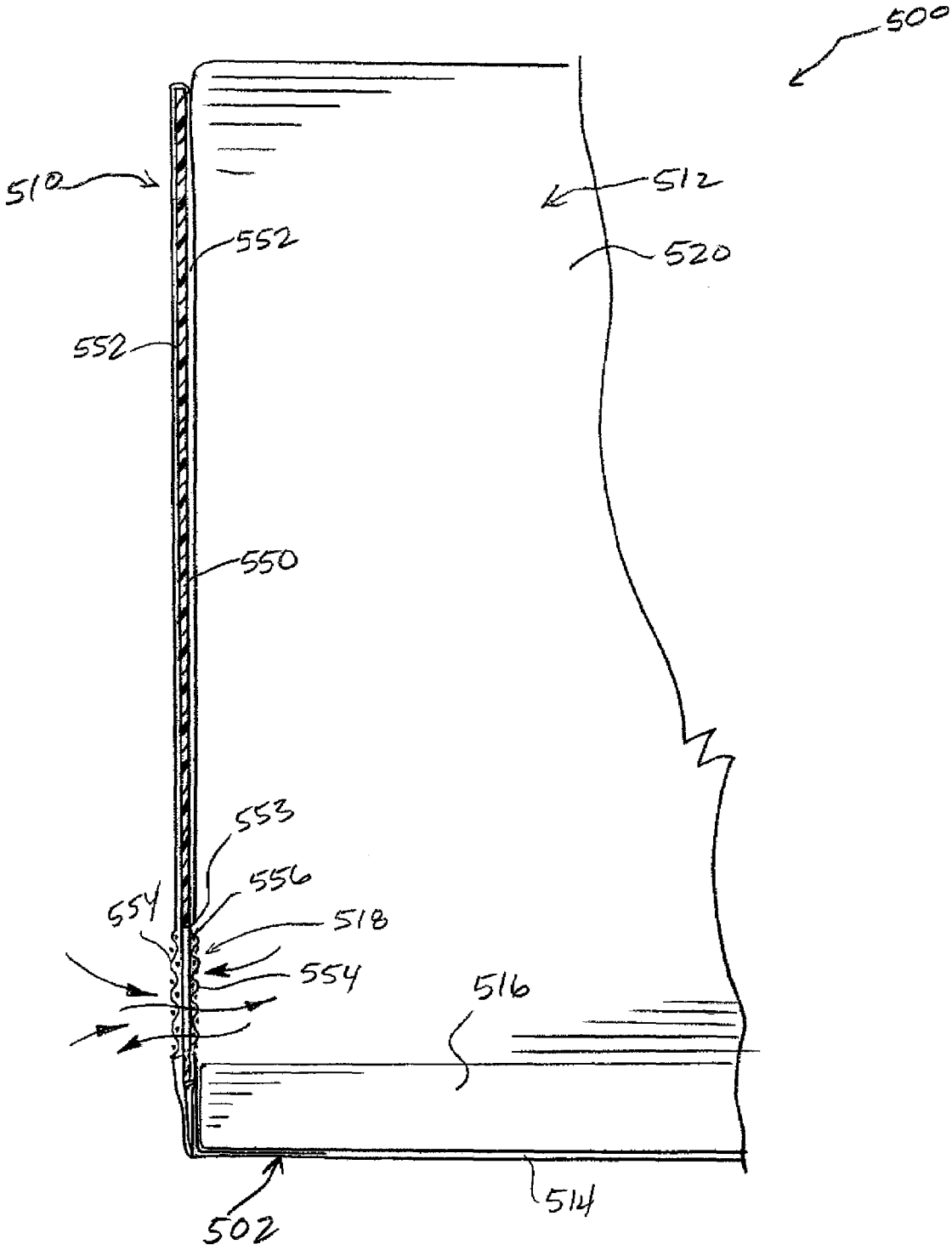
FIG. 14 shows a cross-section of a portion of the portable bassinet taken along line XIV-XIV of FIG. 1.

As noted above, the bassinet 500 is provided with one or more vents 518 in at least a portion of the perimeter side wall. FIGS. 13 and 14 illustrate one possible position and construction of such vents 518 in accordance with the teachings of the present invention. Each panel section 510*a* and 510*b* of the side panel segments 510 has an elongate vent region positioned near the bottom end of the panel segments. The vent regions are placed at about the level of the sleeping surface. Each vent region extends over a substantial portion of the length of the respective side panel section 510*a* and 510*b*. The fold region 530 in each side panel segment 510 does not include any vent region in this example, although it is certainly possible that fold region vents could be provided as well.

As shown in FIGS. 13 and 14, each side wall segment 510 includes a dual layer fabric outer material 550 and an internal semi-rigid panel structure 552 within a pocket between the dual fabric layers. In the disclosed example, the panel structure 552 in each section 510*a*, 510*b* of the wall segments 510 is a separate structure formed of a sturdy yet resilient plastic or other suitable material. Each panel structure 552 has a thickness sufficient to maintain a generally planer, flat configuration in the set up or in-use configuration shown in FIG. 8. Use of plastic makes the walls relatively light and flexible, though resilient to maintain the desired shape. In the disclosed example, the bottom edge of the fabric layers 550 on each side panel segment 510 is integrally connected with or sewn to the bottom fabric 514 along the side edges 506.

An elongate cut out 553 is provided to create each vent region in the fabric layers 550. An open mesh material or window 554 is sewn or otherwise attached to the fabric layer within each of the cut outs. In this example, the mesh material 554 is sewn to the fabric layers 550 on both the inner and outer side of each panel section 510*a*. The mesh windows 554 and cut outs 553 are positioned at a height generally level with the top sleeping surface of the mattress pad. 516 as shown in FIG. 14. A plurality of vent holes 556 are provided through the panel structure 552 that are aligned with and positioned between the mesh windows 554 in each wall section 510*a* and 510*b*. The vent holes 556, cut outs 553, and mesh windows 554 create the vents 518 in this example. Each vent 518 permits air flow between the exterior and interior of the sleeping area in the portable infant bed 500 and yet the material surrounding the vent openings of the panel structure 552 assists in maintaining the resilient and semi-rigid nature of the product.

The vent regions and vents 518 in this example permit an infant to lay on the mattress pad 516 with their face adjacent any portion of the side panel segments 510 and yet be able to breathe plenty of fresh air. In this example, it may be preferable that the width across the bed be such that an infant could not easily lie with their face adjacent one of the end panel segments 512. However, it is also possible that one or more vents be placed at the corners of the bed on the end panel segments, if desired. The vent regions and vents 518 also assist in keeping a sleeping infant cool while lying on the sleeping surface of the bed 500 by permitting free air flow from both sides of the bed.

As will be evident to those having ordinary skill in the art, the number and location of the vent holes 556, vents 518, and/or vent regions can vary within the spirit and scope of the present invention. For example, a plurality of spaced apart vent regions can be provided along each of the sides of the perimeter wall. Alternatively or in addition, one or more vent regions can also be provided along the end panels of the perimeter wall as noted above. The structure within the fold regions 530 on the side panel segments 510 in the disclosed example can also vary within the spirit and scope of the present invention, including having one or more vents. The fold regions can be provided with one or more rigid or semi-rigid structures extending vertically that assist in supporting the central region of each of the side wall segments in the in-use configuration shown in FIG. 8. A fold location can still be provided in such a fold region.

The infant bed 500 disclosed in this example is a portable, compact travel bed for infants that can be easily set up or folded as desired. The bed 500, though foldable to a flat configuration for carrying, still provides vent regions and vents adjacent the sleeping surface of the product to reduce or eliminate the potential of an infant suffocating while sleeping in the bed.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A portable infant bed comprising:

a bottom panel having a perimeter and a top sleeping surface;

a side wall connected to the perimeter of the bottom panel round a periphery of the bed, the side wall having a fabric material layer being restrictive to air flow and a semi-rigid material layer extending around at least a portion of the side wall to support and add sturdiness to the fabric material layer, the bottom panel and side wall being foldable and unfoldable between an in-use configuration with the side wall extending up from the perimeter and surrounding the sleeping surface and a folded configuration with the side wall lying generally parallel with and adjacent the bottom panel;

a cut out region through a portion of the fabric material layer positioned at a level near the sleeping surface, the cut out region permitting air to pass freely through the side wall; and a hole through the semi-rigid material layer aligned with the cut out region to form a vent.

2. A portable infant bed according to claim 1, further comprising a plurality of the vents through the side wall and spaced apart around a periphery of the bed.

3. A portable infant bed according to claim 1, wherein the side wall comprises:

an open mesh material coupled to the fabric material layer and positioned over the cut out region and the hole.

4. A portable infant bed according to claim 1, wherein the bottom panel includes a bottom fabric layer and a removable mattress pad.

5. A portable infant bed according to claim 1, wherein the bottom panel has two sections that can be folded at least in half in the folded configuration and wherein the side wall is positioned between the two sections of the bottom panel in the folded configuration.

6. A portable infant bed according to claim 1, wherein the vent extends only partly around the periphery of the bed.

7. A portable infant bed according to claim 1, further comprising:

a carry strap positioned to be exposed when the infant bed is in the folded configuration.

8. A portable infant bed according to claim 1, wherein the periphery is rectangular in shape and wherein the side wall further comprises:

a pair of elongate side panel segments coupled to opposite side edges of the bottom panel;

a pair of end panel segments coupled to opposite end edges of the bottom panel; and at least one of the vents in each of the side panel segments.

9. A portable infant bed according to claim 8, further comprising:

a plurality of the vents positioned along each of the side panel segments.

10. A portable infant bed according to claim 8, wherein each side panel segment further comprises:

a pocket in the fabric material layer;

a cut out through the pocket at a location of the vent;

a flexible, resilient plastic panel as the semi-rigid material layer received within the pocket; and the hole being through the plastic panel to form the vent.

11. A portable infant bed comprising:

a bottom panel having a perimeter and a top sleeping surface;

a side wall connected to the perimeter of the bottom panel around a periphery of the bed, at least part of the side wall having an air flow restricting fabric material configured to form a pocket between two layers of the material, the bottom panel and side wall being foldable and unfoldable between an in-use configuration with the side wall extending up from the perimeter and surrounding the sleeping surface and a folded configuration with the side wall lying generally parallel with and adjacent the bottom panel;

a cut out through the two layers of the fabric material positioned at a level near the sleeping surface;

a flexible, resilient plastic panel received within the pocket; and a hole though the plastic panel aligned with the cut out to form a vent permitting air to pass freely through the side wall.

12. A portable infant bed according to claim 11, further comprising:

a mesh material attached to the fabric material within the cut out in each of the two layers.

13. A portable infant bed comprising:

a generally rectangular bottom panel having opposed side edges, opposed end edges, a top sleeping surface, and at least two panel sections foldable relative to one another;

a side wall connected to the perimeter of the bottom panel and formed of an air flow restricting fabric;

a plurality of pockets formed in the fabric;

a plurality of plastic panels each received in a corresponding one of the plurality of pockets;

one or more holes through each of the plastic panels; and one or more openings in the fabric aligned with each of the one or more holes forming one or more vents positioned at a level near the sleeping surface and permitting air to pass freely through the side wall, wherein the bottom panel and side wall are foldable and unfoldable between an in-use configuration with the side wall extending up from the perimeter and surrounding the sleeping surface and a folded configuration with the side wall lying generally parallel with and sandwiched between the two panel sections of the bottom panel.

14. A portable infant bed according to claim 13, wherein the fabric of the side wall is a nylon material.

15. A portable infant bed according to claim 13, wherein the side wall further comprises:

a mesh material connected to the fabric within each of the openings in the fabric on both an outer side and an inner side of the plastic panels.

16. A portable infant bed comprising:

a generally rectangular bottom panel having opposed side edges, opposed end edges, a top sleeping surface, and at least two panel sections foldable relative to one another;

a side wall connected to the perimeter of the bottom panel and formed of an air flow restricting fabric;

one or more semi-rigid panels adjacent the fabric;

an opening through the fabric positioned at a level near the sleeping surface; and a hole through the one or more semi-rigid panels, the hole aligned with the fabric opening and together forming a vent permitting air to pass freely through the side wall, wherein the bottom panel and side wall are foldable and unfoldable between an in-use configuration with the side wall extending up from the perimeter and surrounding the sleeping surface and a folded configuration with the side wall lying generally parallel with and sandwiched between the two panel sections of the bottom panel.

17. A portable infant bed according to claim 16, wherein the side wall further comprises:

an open mesh material connected to the fabric within the opening.

* * * * *

UNITED STATES PATENT AND TRADEMARK OFFICE

CERTIFICATE OF CORRECTION

PATENT NO. : 7,404,219 B2
APPLICATION NO. : 11/760044
DATED : July 29, 2008
INVENTOR(S) : Cindy Berkey It is certified that error appears in the above-identified patent and that said Letters Patent is hereby corrected as shown below:

Column 10
claim 1, line 6, please delete “round” and replace with --around--

Signed and Sealed this

Twenty-eighth Day of October, 2008

JON W. DUDAS
*Director of the United States Patent and Trademark Office*